US006347912B1

(12) United States Patent
Thomas

(10) Patent No.: US 6,347,912 B1
(45) Date of Patent: Feb. 19, 2002

(54) INSTALLATION FOR PRODUCING OIL FROM AN OFF-SHORE DEPOSIT AND PROCESS FOR INSTALLING A RISER

(75) Inventor: Pierre-Armand Thomas, Puteaux (FR)

(73) Assignee: Technip France, Paris la Defense Cedex (FR)

( * ) Notice: Subject to any disclaimer, the term of this patent is extended or adjusted under 35 U.S.C. 154(b) by 0 days.

(21) Appl. No.: 09/370,895

(22) Filed: Aug. 10, 1999

(30) Foreign Application Priority Data

Aug. 11, 1998 (FR) ..... 98 10301

(51) Int. Cl.[7] ..... E21B 17/01

(52) U.S. Cl. ..... 405/224.2; 405/205; 405/224; 405/223.1; 166/350; 166/367

(58) Field of Search ..... 166/350, 359, 166/367, 368; 405/195.1, 200, 205, 207, 223.1, 224, 224.1–224.4; 114/264, 265

(56) References Cited

U.S. PATENT DOCUMENTS

| | | | | |
|---|---|---|---|---|
| 3,496,898 A | | 2/1970 | Morgan | 114/294 |
| 4,099,560 A | | 7/1978 | Fischer et al. | 166/350 |
| 4,351,261 A | * | 9/1982 | Shanks | 114/264 |
| 4,473,323 A | | 9/1984 | Gregory | 405/224.4 |
| 4,616,707 A | * | 10/1986 | Langner | 166/367 X |
| 4,617,998 A | | 10/1986 | Langner | 166/345 |
| 4,657,439 A | | 4/1987 | Petersen | 405/200 |
| 5,381,750 A | * | 1/1995 | Pollack | 114/230 |
| 5,447,392 A | * | 9/1995 | Marshall | 405/224.4 |
| 5,524,710 A | * | 6/1996 | Shinn | 166/348 |
| 5,875,848 A | * | 3/1999 | Wolff et al. | 166/367 X |
| 5,971,075 A | * | 10/1999 | Odru et al. | 166/367 X |
| 6,085,851 A | * | 7/2000 | Scott et al. | 405/195.1 X |
| 6,092,483 A | * | 7/2000 | Allen et al. | 114/264 |
| 6,161,620 A | * | 12/2000 | Cox et al. | 166/367 |
| 6,176,646 B1 | * | 1/2001 | Finn et al. | 405/224.2 |

FOREIGN PATENT DOCUMENTS

| | | | |
|---|---|---|---|
| FR | 2729432 | 7/1996 | |
| GB | 2156407 A | * 10/1985 | 166/367 |
| GB | 2317631 | 4/1998 | |

* cited by examiner

*Primary Examiner*—David Bagnell
*Assistant Examiner*—Jong-Suk Lee
(74) *Attorney, Agent, or Firm*—Wenderoth, Lind & Ponack, L.L.P.

(57) ABSTRACT

An installation for producing oil from an off-shore deposit has a semi-submersible platform, at least one riser connecting the platform to the sea bed, and devices for tensioning the riser. The tensioning devices include, for each riser, at least one submerged float connected to a point on the main run of the riser for hauling it towards the surface, and a mechanism for hauling the riser. The mechanism is installed on the platform and applied to the top end of the riser.

11 Claims, 6 Drawing Sheets

INSTALLATION FOR PRODUCING OIL FROM AN OFF-SHORE DEPOSIT AND PROCESS FOR INSTALLING A RISER

BACKGROUND OF THE INVENTION

1. Field of the Invention

The present invention relates to an installation for producing oil from an off-shore deposit, of the type comprising a semi-submersible platform, at least one riser connecting the platform to the sea bed F, and means of tensioning the riser.

2. Description of the Related Art

Semi-submersible platforms are intended for oil production in very deep seas or oceans. They comprise a hull supported by legs, the bottoms of which are connected to a hollow base. The legs have buoyancy boxes. The base and the buoyancy boxes provide the platform with buoyancy and stability. The hull, fixed on the legs, is kept above the surface of the sea while the installation is in production.

One or more of what are commonly known as risers connect the platform to the sea bed. These risers consist of metal tubes.

Their length, which essentially corresponds to the depth of the production site is commonly 1200 m, and their weight is of the order of 100 tons.

To prevent the risers from breaking under the action of transverse currents, it is known practice to provide means of tensioning them. These tensioning means exert a force which corresponds to approximately one to two times the weight of the riser.

Because the platform remains afloat, it is subjected, on the one hand, to the variations in water level due to the tide, and, on the other hand, to movements associated with the heave. In consequence, the means of tensioning the risers must make it possible to compensate for the vertical oscillation of the platform over time. The maximum vertical oscillation is commonly from 4 to 12 m.

In current installations, the means of tensioning the risers comprise hydropneumatically operated rams arranged between the top end of the riser and the platform. These rams need to have a long enough stroke that they can compensate for the relative displacement between the top end of the riser and the platform. Furthermore, these rams have to be powerful enough that they can withstand the hauling force involved in tensioning the riser.

Thus, it will be understood that the rams currently in use are very bulky and employ complex technology.

SUMMARY OF THE INVENTION

The object of the invention is to provide a production installation in which the tensioning of each riser does not require the use of complex and bulky means on the hull of the platform.

To this end, the subject of the invention is an installation for producing oil from an off-shore deposit, of the aforementioned type, characterized in that the tensioning means comprise, for each riser, at least one submerged float connected to a point on the main run of the riser for hauling it towards the surface, and a mechanism for hauling the riser, which mechanism is installed on the platform and applied to the top end of the riser.

According to particular embodiments, the invention comprises one or more of the following features:

- each float is dimensioned to apply to the riser a hauling force which exceeds the hauling force applied by the top-end hauling mechanism;

- the float is dimensioned to apply to the riser a hauling force which is between 1 and 3 times the weight of the riser;
- the platform comprises a submerged base and a hull which is out of the water and connected by legs, each float being arranged at the depth of the base, which base comprises means for the vertical guidance of each float;
- the base comprises, for each float, a vertical passage through which the float can move axially;
- means for bringing the float into abutment against the platform in the upwards direction;
- each float has a through conduit through which the associated riser runs;
- the means providing the link between each float and the associated riser comprises a ball joint;
- the ball joint comprises a concave annular seat secured to the float in the axial conduit and a flange with a convex surface borne by the riser, the flange being pressed against the concave seat in order to apply tension to the riser;
- the through conduit has a diameter greater than three times the diameter of the riser; and
- the top-end hauling mechanism comprises at least one hydropneumatic ram which, at each end, has a series of block-and-tackle pulleys over which at least one hauling line applied to the riser is engaged.

Other subjects of the invention are processes for installing a riser of an installation of the aforementioned type, characterized in that it comprises:

a bringing the float vertically into abutment against the platform;

b immersing the riser with its lower end held some distance from the sea bed;

c weighing the platform down with ballast;

d lowering the riser and connecting it to the sea bed;

e releasing the float from abutment with the platform; and f removing the ballast from the platform.

According to one particular embodiment, the process comprises:

a bringing the float into abutment against the platform;

b immersing the riser with its lower end held some distance from the sea bed;

c sinking the float by placing ballast on the float;

d lowering the riser and connecting it to the sea bed;

e releasing the float from abutment with the platform; and f removing the ballast weighing down on the float.

BRIEF DESCRIPTION OF THE DRAWINGS

The invention will be better understood from reading the description which will follow, which is given merely by way of example, and by referring to the drawings, in which.

DETAILED DESCRIPTION OF THE INVENTION

Figure 1:
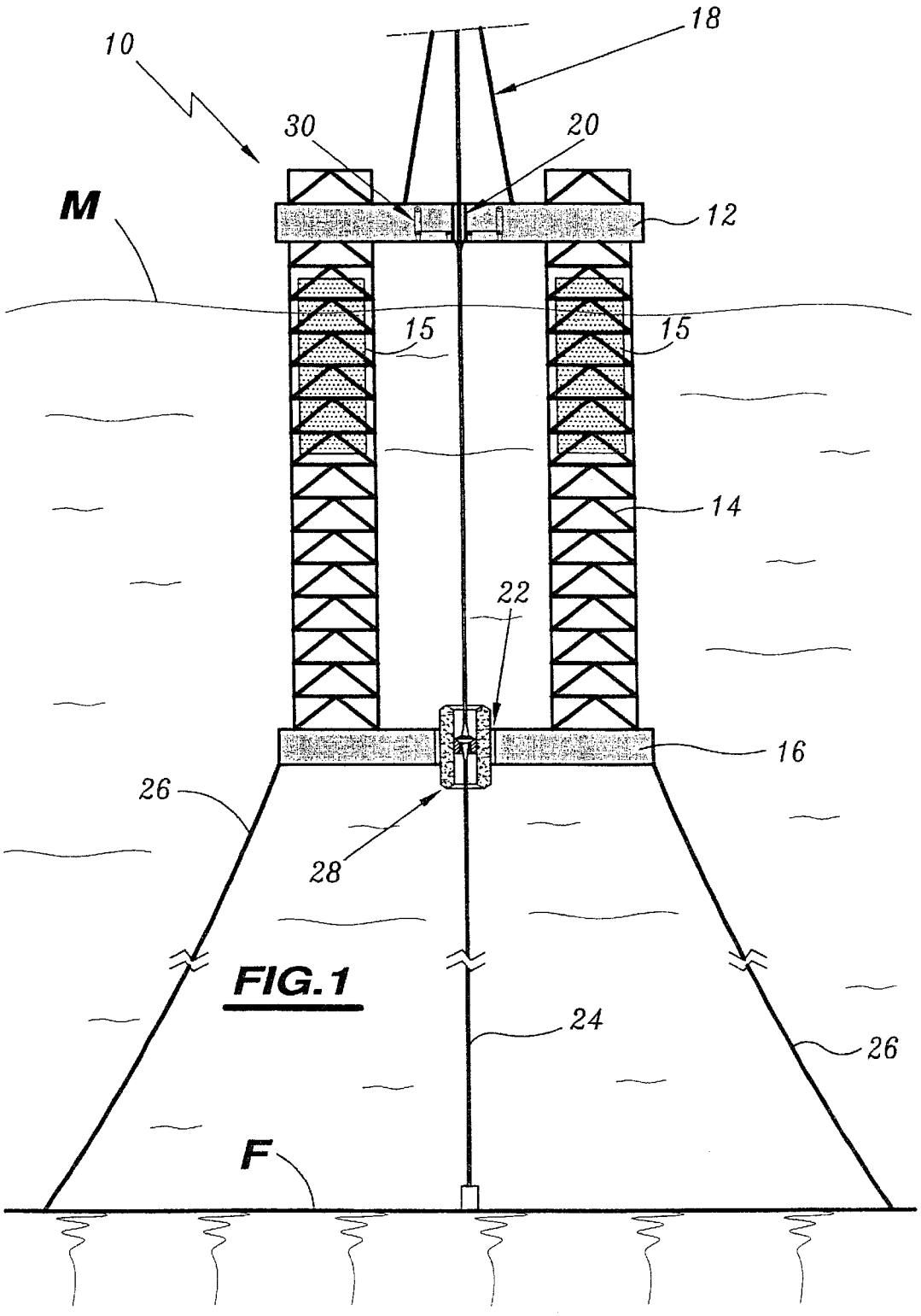
FIG. 1 is an elevation of an oil production platform according to the invention.

FIG. 1 diagrammatically depicts a jack-up oil platform 10 of the semi-submersible type. It is sited in a very deep region of the sea, for example 1300 meters deep.

The platform essentially comprises an upper hull 12 extending above the surface M of the sea, when the platform is in a production phase. The hull 12 is connected, by four legs 14 equipped with buoyancy boxes 15, to a submerged lower base 16. The upper hull comprises technical living quarters, not depicted, and a derrick 18. The hull 12 and the base 16 are both square, and their center, have through conduits 20, 22 intended for the passage of a riser 24. The riser 24 is connected at its bottom end to a production well.

Just one riser 24 is depicted in FIG. 1. In practice, several risers are arranged between the platform 10 and the sea bed F. Vertical conduits similar to the conduits 20 and 22 are provided for each riser.

The total weight of each riser 24 is, for example, 100 tons. Its diameter is 10 inches, namely about 25 cm.

Tethers 26, kept under tension, are installed between the submerged base 16 and the sea bed, to hold the platform in place over the deposit.

Each riser 24 is associated with tensioning means. According to the invention, these tensioning means comprise, for each riser, at least one submerged (submersible) float 28 connected to a point on the main run of the riser in order to haul it towards the surface, and a riser hauling mechanism 30, which mechanism is installed on the platform 10 and is applied to the top end of the riser 24.

The submerged float 28 is at the depth of the base 16. It is thus mounted so that it can be displaced vertically in the passage 22.

Figure 2:
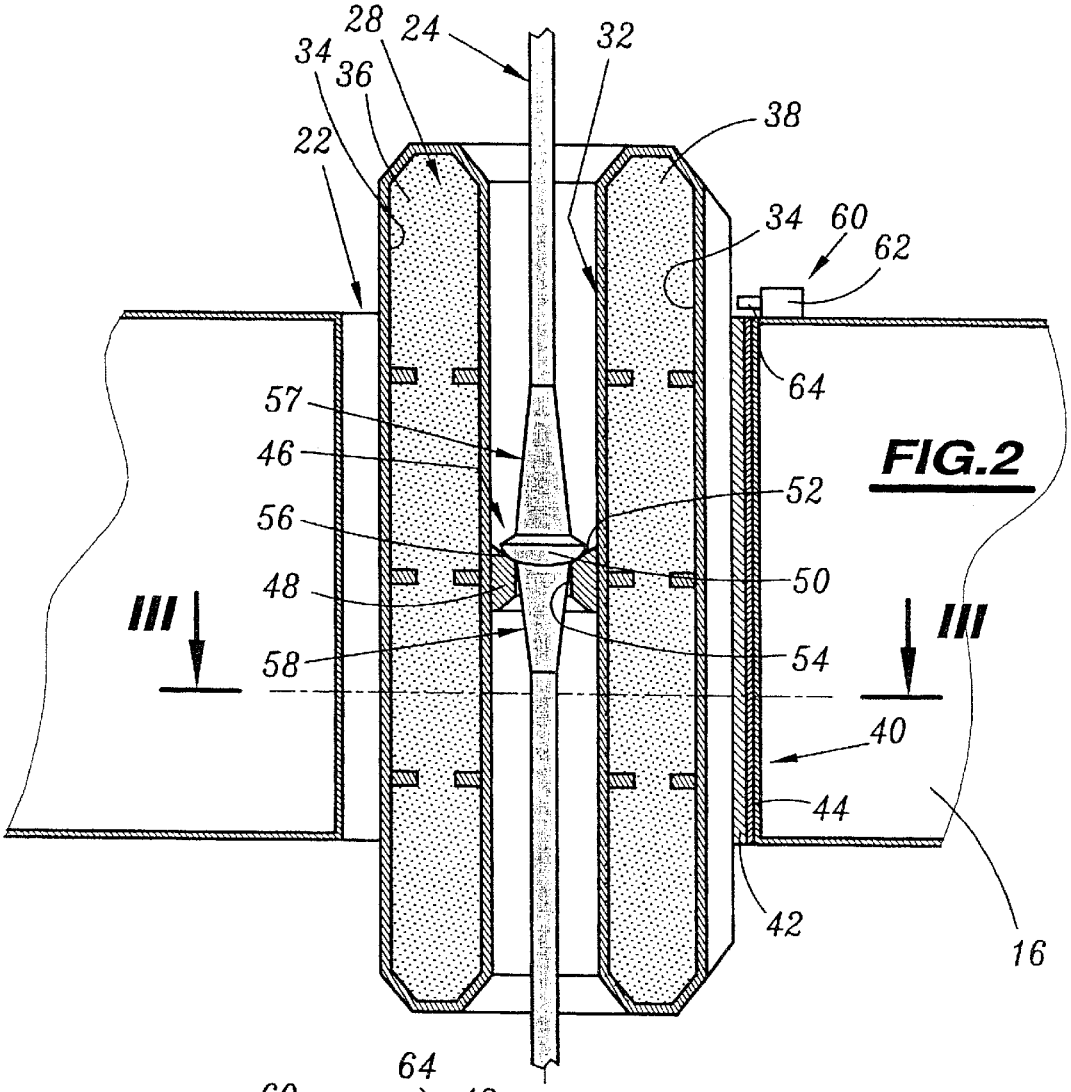
FIGS. 2 and 3 are views respectively in longitudinal and in transverse section of a float for hauling on the riser of the installation of FIG. 1.
Figure 3:
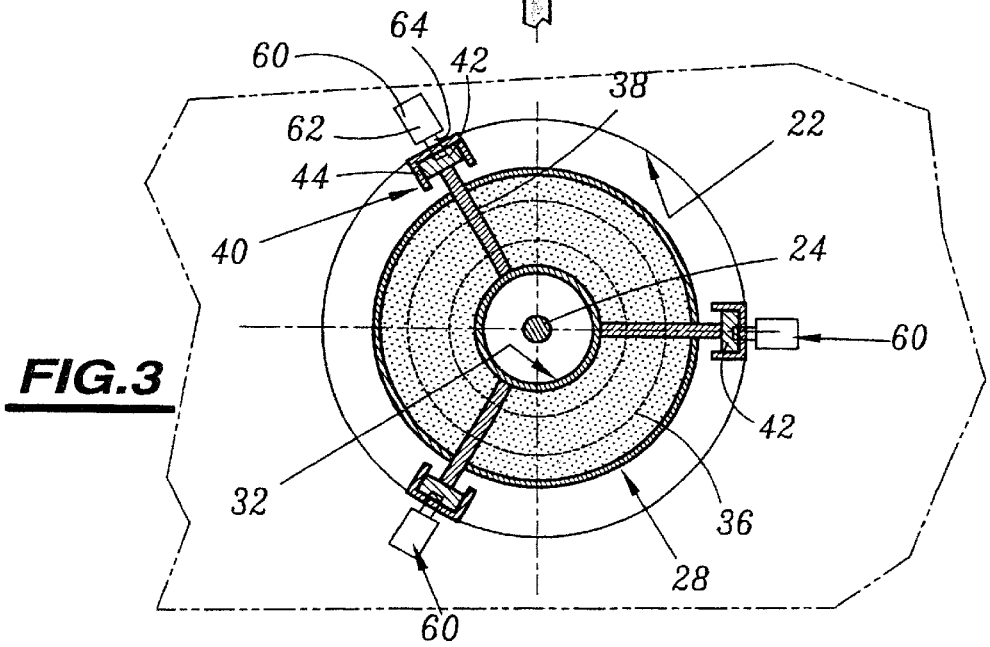

FIGS. 2 and 3 depict, in section, on a larger scale, the float 28 passing through the passage 22.

As depicted in these figures, the float 28 is in the shape of a sleeve. The height of the float is, for example, 13 m and its outside diameter is, for example, 4.5 meters. There is a passage 32 along the axis of the float. The riser 24 is engaged through this passage.

The diameter of the passage 32 is, for example, 1.7 m. It is advantageously greater than three times the diameter of the run of riser 24.

The float 28 consists of a toroidal box 34 delimited by metal walls. The interior of the box is filled with low-density synthetic foam 36. The box 34 is divided into three separate compartments by radial partitions 38 extending over the entire height of the float. These partitions start along the wall delimiting the passage 32 and project radially from the box 34.

Between the float 28 and the base 16 of the platform there are vertical guide means 40 for guiding the float in the vertical direction. These guide means 40 comprise, for example, sliding blocks 42 borne by the ends of the radial partitions 38 projecting from the box. These sliding blocks are free to slide in guide slideways 44 arranged longitudinally along the passage 22. The guiding slideways 44 are, for example, defmed by U-shaped channel sections running the entire thickness of the base 16, namely about 10 m.

The blocks 42 are continuous and extend over a length equal to that of the guiding slideways 44. As an alternative, these blocks consist of separate elements spread along the height of the radial partitions 38.

According to another alternative embodiment which has not been depicted, the positions of the slideways and of the blocks are reversed. The blocks, which are therefore borne by the base, are secured to a guide liner attached and fixed into the through conduit 22. When the blocks are worn, the guide liner is removed and replaced with a liner bearing new blocks.

Furthermore, the passage 32 contains means 46 of axially connecting the float 28 and the riser 24. These connecting means are formed by a ball-joint arrangement allowing the riser 24 the freedom of angular movement with respect to the float 28.

This ball-joint arrangement advantageously comprises a concave annular seat 48 secured to the float 28 and a flange 50 with a convex surface borne by the riser 24.

The annular seat 48 is advantageously arranged in the lower half of the passage 32. It defines a frustoconical concave surface 52 facing upwards. This surface is intended to form a dish-shaped surface on which the flange 50 will bear. Passing through the seat 48 is a conduit 54 designed for the passage of the riser 24. The conduit 54 is, for example, 1 m in diameter.

Facing the bearing surface 52, the flange 50 has a convex surface 56, formed, for example, by a spherical ring.

The largest diameter of the flange 50 is smaller than the diameter of the passage 32.

In the region where it connects with the flange 50, the riser 24 is thicker, so as to strengthen its structure.

From the flange 50, the thickness of the riser decreases gradually in two portions labeled 57, 58 which face upwards and downwards, respectively.

These portions are each, for example, 3 m long. They constitute portions of varying second moment of area, allowing stress to be spread uniformly over their entire length.

Furthermore, provided on the upper face of the base 16 at the periphery of the passage 22 are three latches 60 constituting retractable stops designed to selectively hold the float 28 and prevent it from rising.

The releasable latches 60 each comprise, for example, a hydraulic actuator 62 which can be operated from the hull 12 or from a remote-controlled underwater operations vehicle. They allow a lock bolt 64 to be deployed at the top end of the slideways 44.

The lock bolts 64 can move between a retracted position, in which they allow the blocks 42 to slide freely in the slideways 44, and an active, abutment, position as depicted in FIGS. 2 and 3, in which they prevent the upwards movement of the blocks 42.

The float is dimensioned to apply to the riser a hauling force which is between 1 and 3 times the weight of the riser. For a riser 24 weighing 100 tons, the force exerted by the float is, for example, between 1000 kN and 2000 kN. Advantageously, this hauling force is roughly equal to 1500 kN. Such being the case, the force applied by the top-end hauling mechanism 30 is roughly equal to 500 kN.

In general, the float 28 is dimensioned to apply to the riser a hauling force which exceeds the hauling force applied by the top-end hauling mechanism 30.

Advantageously, the hauling force of the float is between 1 and 10 times the hauling force applied by the top-end hauling mechanism.

In practice, the float applies to the riser a hauling force roughly equal to 3 times the hauling force applied by the top-end hauling mechanism 30.

The float is dimensioned so that the capacity of the top-end hauling mechanism is a maximum of 500 kN.

Figure 4:
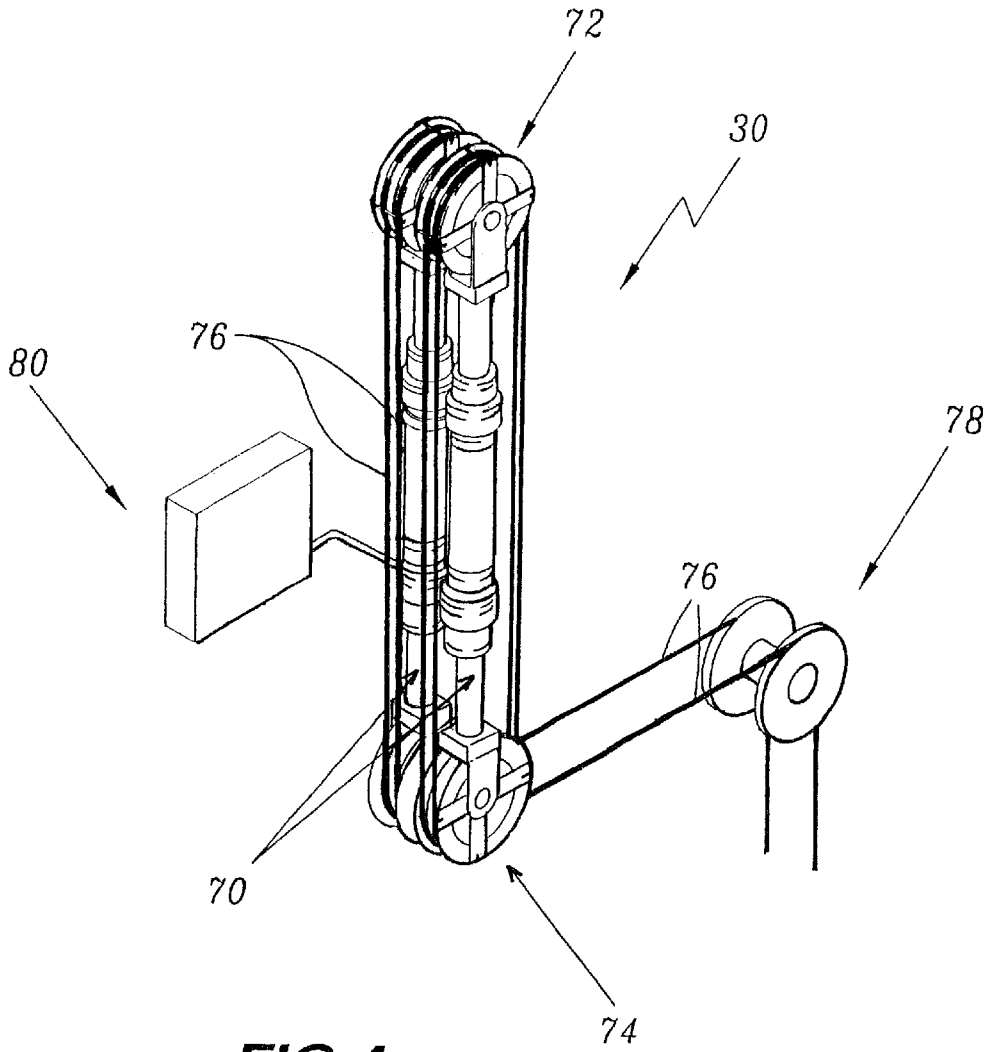
FIG. 4 is a perspective view of riser top-end hauling means.

The top-end hauling mechanism 30 depicted in FIG. 4 comprises two hydropneumatic rams 70 mounted in parallel.

Mounted at each end of the rams are four block-and-tackle pulleys labeled 72 and 74. A cable 76 for tensioning the riser 24 is engaged around the pulleys. The cable 76 is passed over a return pulley 78 and directed towards the top end of the riser, to which it is fixed.

The rams 70 are supplied with hydraulic fluid by a hydraulic-pressure regulator assembly labeled 80. Varying the hydraulic pressure in the rams 70 allows their travel to be controlled.

Passing the cable 76 between the block-and-tackle pulleys 72 and 74 provides a demultiplication of the travel of the rams, so that, in order to bring about an axial movement of 15.2 m at the top end of the riser 24, the ram travel is merely 3.8 m.

The top-end hauling mechanisms 30 are built into the thickness of the hull 12 as depicted in FIG. 1. They do not therefore clutter the upper deck of the hull 12.

As an alternative, the top-end hauling means 30 are offset into the side walls of the hull, the cables 76 then running from the breastwork to the top of the riser through the hull 12.

It will be understood that with such an installation, the riser 24 is forced upwards both by the float 28 and by the top-end hauling mechanism 30.

Thus, because of the hauling force exerted by the float 28, the hauling capacity of the mechanism 30 may be lessened. It is thus not necessary to use bulky rams with a long travel corresponding to the maximum movement encountered between the top end of the riser and the platform.

In addition, since the diameter of the conduit 32 through which the riser 24 passes is very much greater than the diameter of this riser, and because the float and the riser are connected by means of a ball joint, the riser is free to move angularly with respect to the float, thus reducing the stresses applied to the riser 24.

FIGS. 5A to 5E illustrate a first method of installing the riser 24.

Figure 5C:
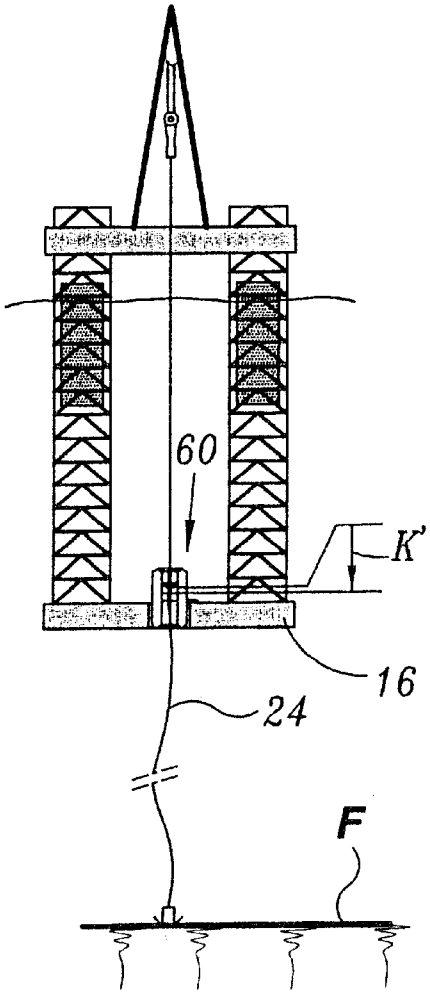
FIGS. 5A, 5B, 5C, 5D and 5E are diagrammatic views showing the oil production installation of FIG. 1 at successive stages in the installing of a riser.
Figure 5B:
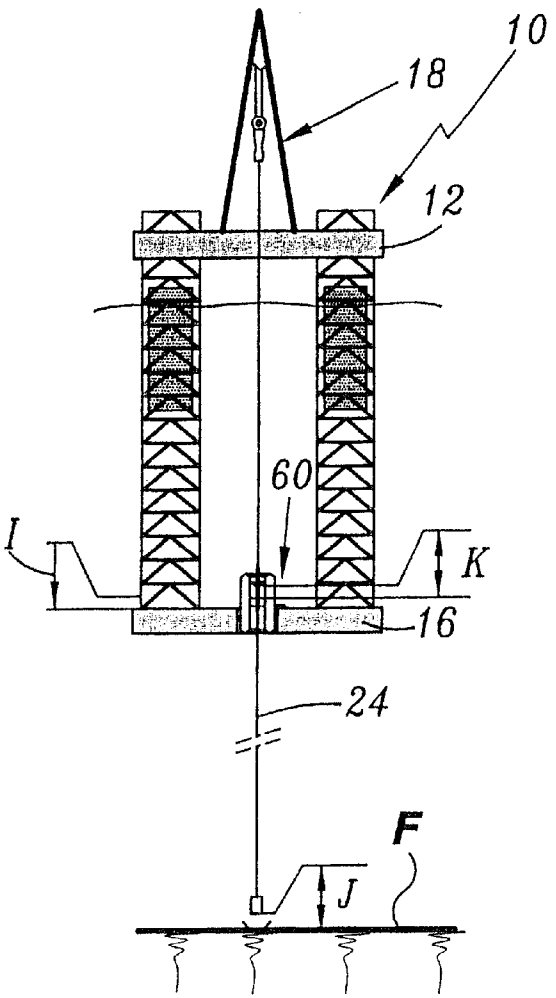
Figure 5A:
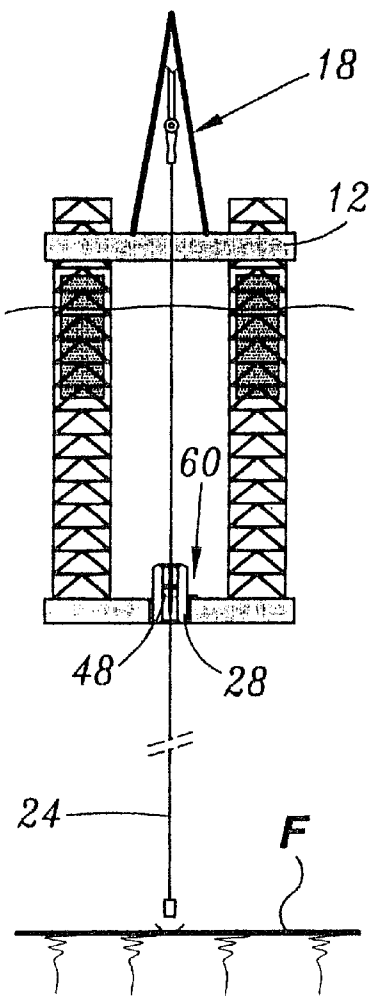

As depicted in FIG. 5A, the riser 24 is first submerged with its lower end kept some distance from the bottom F. The float 28 is kept in abutment against the lock bolts 64, thus preventing the float from rising. In this position, the flange 50 is roughly at the depth of the seat 48. The bottom of the float 28 lies roughly flush with the bottom of the base 16.

During the next step in the process, the platform 10 is weighted down with ballast, for example by partially filling the base 16. The platform 10 thus sinks by a depth I as marked in FIG. 5B. The depth I is, for example, 1.5 m. Because of the derrick 18, the riser 24 is pulled upwards as the platform is lowered, so that the lower end of the riser remains a distance J away from the sea bed F which, for example, is one meter off the bottom. In this position, the flange 50 is situated above the seat 48 and is separated from this seat by an amount K approximately equal to 1.5 m.

After this step, and as depicted in FIG. 5C, the riser 24 is lowered down to the bottom and is connected to a previously drilled and cased production well. During this lowering, the immersion depth of the platform is kept constant.

In this position, the flange 50 is a distance K' roughly equal to 0.5 m off the seat 48. The portion of riser lying between its lower end and the float is slack.

Figure 5E:
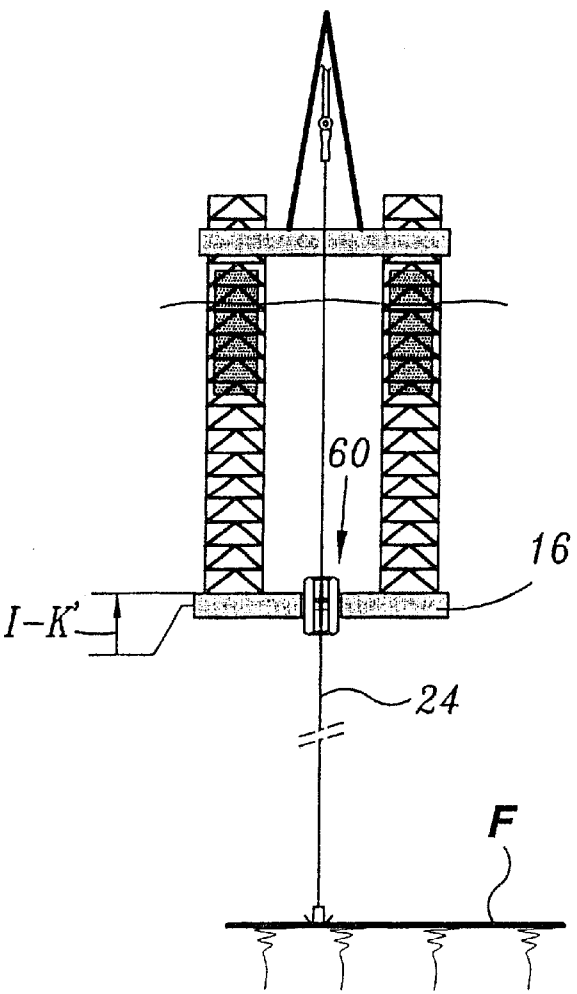
Figure 5D:
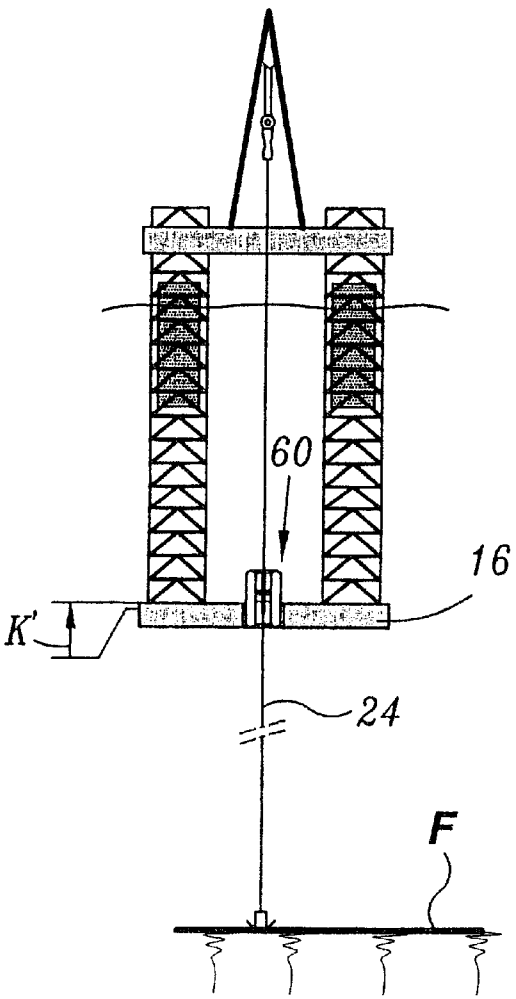

The next phase of the process consists first of all in connecting the top-end hauling mechanism 30 to the riser 24, and then gradually removing ballast from the platform until the flange 50 comes to rest on the seat 48, as depicted in FIG. 5D. The platform 10 is thus raised again by the distance K'. As ballast is removed, the derrick 18 is gradually eased off to allow relative movement between the riser and the platform.

Upon subsequent removal of ballast from the platform, the float comes free of the stops 60 because it is held by the riser 24. Thus, as depicted in FIG. 5E, the platform continues to rise as far as its production position while the float 28 remains at a constant depth. This second rising phase corresponds to a distance I-K' about 1 m high.

In this position, the float 28 exerts a force returning the bottom part of the riser towards the surface.

After the float 28 comes free of the stops 60, these stops are retracted to allow maximum vertical movement of the float with respect to the base 16.

Likewise, the top-end hauling mechanism 30 are actuated so as to haul on the upper portion of the riser 24 lying between the derrick 18 and the float 28.

It will be understood that because of the height of the float, the float is capable of performing large-amplitude movements with respect to the base 16 of the platform, while at the same time being appropriately guided by the lateral guide means 40.

Another process for setting in place a riser of an installation according to the invention is illustrated in FIGS. 6A to 6D.

To implement this process, the hull 12 of the platform is equipped with winches 90 allowing an annular ballast weight 92 to be suspended over the float 28. The annular ballast weight 92 is formed of two half annuli assembled around the riser 24. The winch is long enough to allow the ballast weight 92 to be deposited on the upper annular surface of the float 28. Furthermore, the weight of the ballast weight 92 is designed to sink the float 28 towards the bottom.

As in the previous embodiment, the riser 24 is submerged with its lower end kept some distance from the bottom F. During this installation of the riser, the float 28 is in abutment against the lock bolts 64.

The ballast weight 92 is then winched down onto the float. Thus, the float 28 is made to sink as depicted in FIG. 6B.

Figures 6A, 6B, 6C, 6D:
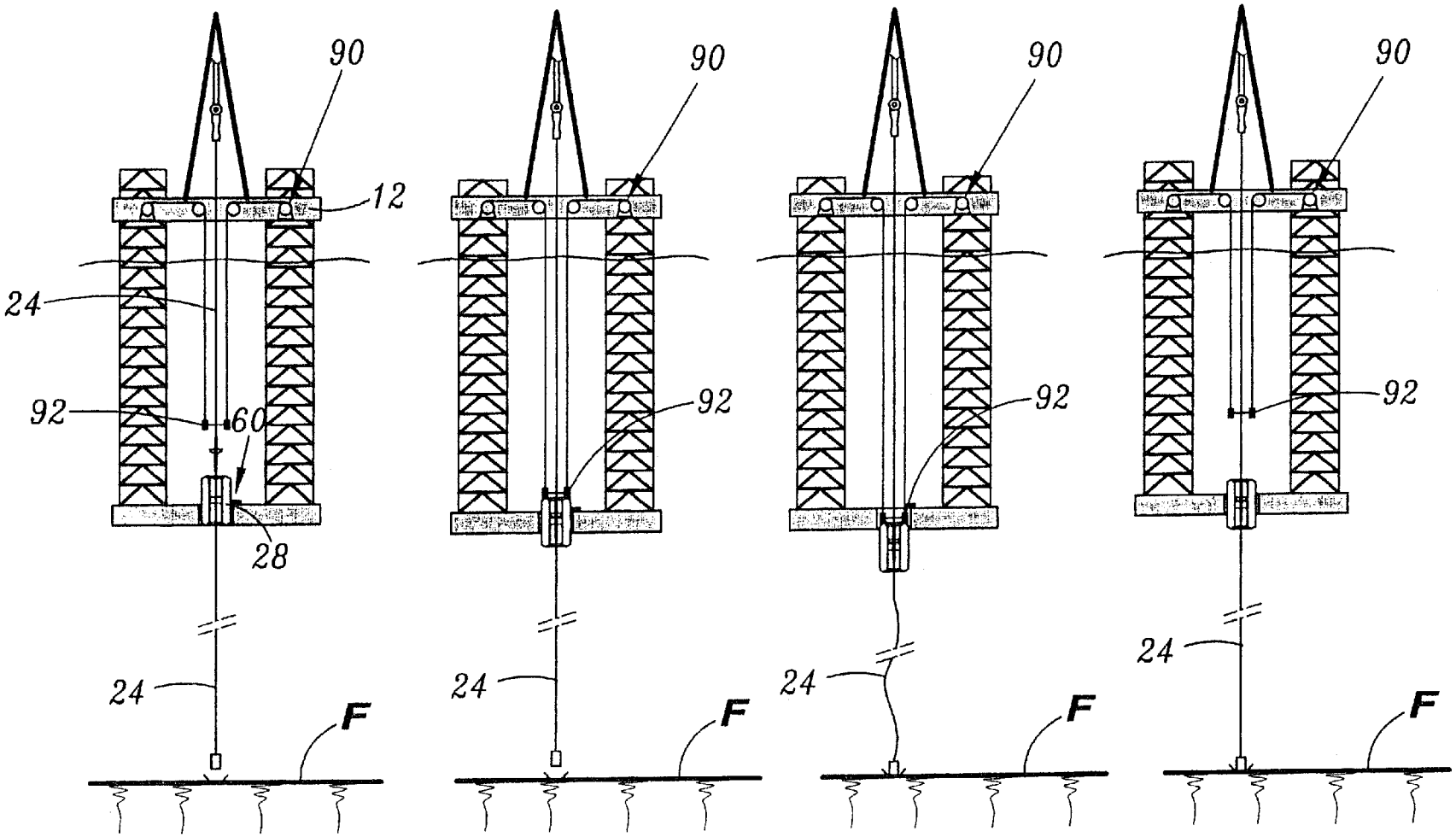
FIGS. 6A, 6B, 6C, 6D are views similar to FIGS. 5A to 5E, illustrating a second process of setting a riser in place.

When the float 28 has sunk sufficiently, the riser is lowered and its lower end is connected to an oil production well as depicted in FIG. 6C. Because the float 28 has sunk, the flange 50 of the riser is away from the seat 48. Such being the case, the riser 24 is slack, which allows it to be connected to the production well.

After the lower end of the riser has been connected, the ballast weight 92 is raised back up, as depicted in FIG. 6D. As the stop provided by the latch 60 has been disengaged, the float 28 tends to rise up towards the surface, which means that it exerts on the riser 24 an upwards hauling force which is applied to the flange 50.

In this process of installing a riser, which employs a ballast weight, there is no need to weigh the platform or the float down with ballast, thus avoiding transfers of seawater.

What is claimed is:

1. An installation comprising:

a semi-submersible platform;

at least one riser having a main run, said at least one riser being operable to connect said semi-submersible platform to a sea bed;

at least one submersible float connected to said main run of said at least one riser, said at least one submersible float being operable to haul said at least one riser towards a surface of a sea;

a hauling mechanism located on said semi-submersible platform and connected to said at least one riser, said hauling mechanism being operable to haul said at least one riser; and at least one releasable latch being operable to bring said at least one submersible float into abutment against said semi-submersible platform in an upward direction, and to release said at least one submersible float from the abutment wherein said at least one submersible float and said hauling mechanism are operable to tension said at least one riser via hauling.

2. The installation according to claim 1, wherein said at least one submersible float is dimensioned to apply to said at least one riser a hauling force that exceeds a hauling force being applied by said hauling mechanism.

3. The installation according to claim 1, wherein said at least one submersible float is dimensioned to apply to said at least one riser a hauling force of between 1 and 3 times a weight of said at least one riser.

4. The installation according to claim 1, wherein said semi-submersible platform comprises:

a submersible base comprising vertical guide means for vertically guiding said at least one submersible float;

a hull to be located above water; and a plurality of legs connecting said submersible base and said hull, wherein said at least one float is arranged at a depth of said submersible base.

5. The installation according to claim 4, wherein said submersible base further comprises for each of said at least one submersible float, a vertical passage through which said at least one submersible float can move axially.

6. The installation according to claim 1, wherein said at least one submersible float has a through conduit through which said at least one riser runs.

7. The installation according to claim 6, wherein said through conduit has a diameter greater than three times a diameter of said at least one riser.

8. The installation according to claim 1, further comprising a ball joint operable to connect said at least one submersible float to said at least one riser.

9. The installation according to claim 8, wherein said at least one submersible float has a through conduit through which said at least one riser runs, and wherein said ball joint comprises:

a concave annular seat secured to said at least one submersible float in said through conduit; and a flange with a convex surface borne by said at least one riser, said flange being pressed against said concave annular seat to apply tension to said at least one riser.

10. The installation according to claim 1, wherein said hauling mechanism comprises:

at least one hydropneumatic ram;

a series of block-and-tackle pulleys located at each end of said at least one hydropneumatic ram; and at least one hauling line engaged with said series of block-and-tackle pulleys and connected to said at least one riser.

11. A process for installing a riser of an installation, said process comprising:

bringing at least one submersible float connected to the riser vertically into abutment against a semi-submersible platform;

immersing the riser in a sea with a lower end of the riser held some distance from a sea bed;

weighing the semi-submersible platform down in the sea with ballast;

lowering the riser and connecting it to the sea bed;

releasing the at least one submersible float from abutment with the semi-submersible platform; and removing the ballast from the semi-submersible platform.

* * * * *